US008696419B2

(12) United States Patent
Liang et al.

(10) Patent No.: US 8,696,419 B2
(45) Date of Patent: Apr. 15, 2014

(54) VENTILATION FAN UNIT WITH A HEATER

(75) Inventors: Qiu Qian Liang, Foshan (CN); Xin Cheng Huang, Foshan (CN)

(73) Assignees: Panasonic Ecology Systems Guangdong Co., Ltd., Guangdong (CN); Panasonic Corporation, Osaka (JP)

( * ) Notice: Subject to any disclaimer, the term of this patent is extended or adjusted under 35 U.S.C. 154(b) by 991 days.

(21) Appl. No.: 12/392,541

(22) Filed: Feb. 25, 2009

(65) Prior Publication Data

US 2009/0275280 A1 Nov. 5, 2009

(30) Foreign Application Priority Data

May 5, 2008 (CN) ..... 2008 1 0096716

(51) Int. Cl.

| | |
|---|---|
| ***F24F 7/06*** | (2006.01) |
| ***F24H 3/04*** | (2006.01) |
| ***F24F 13/06*** | (2006.01) |

(52) U.S. Cl.

USPC ..... 454/338; 454/258; 454/354; 454/261; 454/275; 392/349

(58) Field of Classification Search

USPC ..... 454/275, 261, 258, 338; 392/349

See application file for complete search history.

(56) References Cited

U.S. PATENT DOCUMENTS

| | | | | |
|---|---|---|---|---|
| 1,644,595 A | | 10/1927 | Karg | |
| 1,661,282 A | * | 3/1928 | Carmean et al. | 312/351 |
| 1,982,139 A | | 11/1934 | Kercher | |
| 1,991,280 A | | 2/1935 | Hynes | |
| 2,065,873 A | * | 12/1936 | Ruff | 165/60 |
| 2,263,174 A | * | 11/1941 | Klauber | 392/363 |
| 2,270,665 A | * | 1/1942 | Wheller | 165/281 |
| 2,445,250 A | | 7/1948 | Steingruber | |
| 2,449,755 A | * | 9/1948 | Taylor | 392/349 |
| 3,025,382 A | | 3/1962 | Eisele | |

(Continued)

FOREIGN PATENT DOCUMENTS

| | | |
|---|---|---|
| CA | 679120 | 1/1964 |
| JP | 2000-274944 | 10/2000 |

(Continued)

OTHER PUBLICATIONS

Merriam-Webster's Collegiate Dictionary, Tenth Edition, 1997, p. 802.*

(Continued)

*Primary Examiner* — Kang Hu
*Assistant Examiner* — Phillip E Decker
(74) *Attorney, Agent, or Firm* — Greenblum & Bernstein, P.L.C.

(57) ABSTRACT

A ventilation fan unit with a heater, including: a frame with an opening provided at the underside of the frame; a cover having an air outlet and an air inlet provided at the opening of the frame; a snail-shaped casing with an air exit provided in the frame; a circulating fan enclosed in the snail-shaped casing; and a heating portion including a spiral heater mounted at the air exit of the snail-shaped casing, wherein the heating portion is communicated with the circulating fan through the air exit, wherein an axis of a spiral shape of the heater is in parallel with a rotation axis of the circulating fan, wherein the rotation axis of the circulating fan is located obliquely above the axis of the spiral shape of the heater.

18 Claims, 8 Drawing Sheets

(56) References Cited

U.S. PATENT DOCUMENTS

| | | | | | |
|---|---|---|---|---|---|
| 3,061,706 | A * | 10/1962 | Lundbom | 392/349 |
| 3,202,797 | A * | 8/1965 | Uthoff | 392/383 |
| 3,214,936 | A * | 11/1965 | Di Peri | 62/314 |
| 3,575,583 | A * | 4/1971 | Brown | 392/379 |
| 3,624,350 | A * | 11/1971 | Sanders | 392/349 |
| 3,746,464 | A * | 7/1973 | Goettl | 415/201 |
| 3,938,348 | A * | 2/1976 | Rickert | 62/97 |
| 4,035,610 | A * | 7/1977 | Roth | 392/349 |
| 4,867,640 | A * | 9/1989 | Penlesky et al. | 415/204 |
| 5,611,967 | A * | 3/1997 | Jane et al. | 392/405 |
| 5,755,107 | A * | 5/1998 | Shirota et al. | 62/244 |
| 5,839,879 | A * | 11/1998 | Kameoka et al. | 415/206 |
| 6,261,175 | B1 * | 7/2001 | Larson et al. | 454/354 |
| 6,430,364 | B2 * | 8/2002 | Kishita | 392/360 |
| 6,488,579 | B2 * | 12/2002 | Larson et al. | 454/354 |
| 6,950,606 | B2 * | 9/2005 | Logan et al. | 392/360 |
| 7,203,416 | B2 | 4/2007 | Craw et al. | |
| 2007/0074725 | A1 * | 4/2007 | Taya | 128/204.21 |
| 2007/0143914 | A1 | 6/2007 | Shirai et al. | |
| 2007/0256816 | A1 * | 11/2007 | Higashida et al. | 165/120 |

FOREIGN PATENT DOCUMENTS

| | | |
|---|---|---|
| JP | 2001-311525 | 11/2001 |
| JP | 2002-081858 | 3/2002 |
| JP | 3-515241 | 4/2004 |
| JP | 2006-300363 | 11/2006 |

OTHER PUBLICATIONS

English language Abstract of JP 2001-311525.
English language Abstract of JP 2002-081858.
English language Abstract of JP 2000-274944.
English language Abstract of JP 2006-300363.
English language Abstract of JP 3-515241.

* cited by examiner

PRIOR ART

VENTILATION FAN UNIT WITH A HEATER

BACKGROUND OF INVENTION

1. Field of Invention

The present invention relates to a ventilation fan unit, and more particularly, to a ventilation fan unit with a heater.

2. Prior Art

FIG. 1 is a schematic view of a prior-art ventilation fan unit 100 for warming a bathroom. Such ventilation fan unit is installed in a bathroom to warm the bathroom by a heater. The ventilation fan unit is connected with the outdoor through connected pipes to ventilate the air of the bathroom with the outdoor.

As shown in FIG. 1, the ventilation fan unit includes a frame 10 with a non-box type shape, which has an opening formed at the under side of the frame 10, and a cover 20 having a part of the air outlet 21 and the air inlet 22, which is provided at the opening of the frame 10. The frame 10 has three main portions, including a first portion 30 having a ventilating fan 31, a second portion 40 having a circulating fan 400, and a third portion 50 having a heater 500.

In use, the ventilating fan 31 of the first portion 30 is communicated with the outdoor through the opening of the frame 10 and a pipe, such that air is inhaled from the bathroom via the air inlet 22 of the cover 20 by the ventilating fan 31, and then the inhaled air is exhaled to the outdoor.

The circulating fan 400 of the second portion 40 is communicated with the third portion 50 having the heater 500. The circulating fan 400 generates airflow toward the third portion 50 after the air is inhaled from the bathroom via the air inlet 22 of the cover 20. The third portion 50 is in communication with the air outlet 21 of the cover 20 through an opening, and the air is exhaled via the air outlet 21 after the air is heated.

However, as the heater is not effective for rapid heating due to the structure, the location, and the like thereof, such ventilation fan unit having a heater has some problems, such as weak heating effect for rapid heating.

Therefore, it is needed and desirable to develop a ventilation fan unit with rapid heating function.

SUMMARY OF THE INVENTION

Accordingly, the first object of present invention is to provide a warming ventilation fan unit, which is able to improve the heat exchanging capability and to obtain warmed air rapidly on the basis of a miniaturized structure and a convenient assembling performance.

The second object of present invention is to provide a warming ventilation fan unit so that the user does not feel cold by the airflow from the ventilation fan unit.

In order to achieve an object of the present invention, there is provided a ventilation fan unit with a heater, including:

a frame with an opening provided at the underside of the frame;

a cover having an air outlet and an air inlet provided at the opening of the frame;

a snail-shaped casing with an air exit provided in the frame;

a circulating fan enclosed in the snail-shaped casing; and a heating portion including a spiral heater mounted at the air exit of the snail-shaped casing, wherein the heating portion is communicated with the circulating fan through the air exit, wherein an axis of a spiral shape of the heater is in parallel with a rotation axis of the circulating fan, wherein the rotation axis of the circulating fan is located obliquely above the axis of the spiral shape of the heater.

Words "above", "upper portion" refer to the upper and lower positions in the state that the product is installed in a bathroom.

The sectional area in the spiral direction of the heater may be less than the area of the air exit of the snail-shaped casing.

The ventilation fan unit may include a air guiding plate having a straight strip shape, which is provided on a first wall plate opposite to the air exit of the snail-shaped casing, while the heater is interposed between the air exit of the snail-shaped casing and the air guiding plate, wherein the air guiding plate has an angle for the first wall plate.

The air guiding plate may be angled by cooperating with a lead angle of the spiral shape of the spiral shaped heater.

The ventilation fan unit may include a rectification plate connected at the upper portion of the air exit of the snail-shaped casing, downwardly angled toward the first wall plate, and located at the upper portion of the heater.

The ventilation fan unit may include a temperature overheating protection device mounted at an upper side of the rectification plate, above the heater.

The temperature overheating protection device may be a temperature fuse.

A temperature sensor may be mounted on the rectification plate to sense the temperature of the air heated by the heater. Once the abnormal temperature is found, the alarm is sent out or the power of the heater is turned off automatically.

A lower side of the heater may have a protection cover for covering an opening of the heating portion so as to prevent the user's finger from being stretched in the heating portion.

The circulating fan may be provided with a normal mode and a breeze mode. When the heater is not completely heated after being powered on, the breeze mode is performed firstly, and then, if the heater is completely heated, the normal mode is performed.

After the heater is powered off, the circulating fan is powered off to stop the operation after it performs the breeze mode until a predetermined temperature of the heater is reached.

A device for adjusting the air volume may be provided for controlling the circulating fan, to stabilize a temperature of the airflow by adjusting the volume of the air.

An air temperature adjusting device may be provided for controlling the circulating fan to adjust the temperature of the airflow.

The ventilation fan unit with the heater may includes:

a ventilating fan provided in the frame, and a second wall plate communicated with the air exit of the snail-shaped casing of the circulating fan, wherein one end of the second wall plate located at the opening of the heating portion is bent inwardly.

A partition plate between the second portion and the third portion is integrated with a partition plate between the third portion and the first portion, and both the second portion and the third portion are located at a side of the partition plate.

An upper portion of the rectification plate is fixed by a hook and a lower portion of the rectification plate is fixed by a screw.

In conclusion, it is advantageous that the present invention can generate comfortable airflow so that the cold airflow is avoided.

BRIEF DESCRIPTION OF THE DRAWINGS

The present invention will become readily understood from the following description of preferred embodiments thereof made with reference to the accompanying drawings, in which like parts are designated by like reference numeral and in which:

FIG. 4B is a control flow chart of the ventilation fan unit with the heater of the present invention, when the ventilation fan unit is powered on.

DETAILED DESCRIPTION OF THE PREFERRED EMBODIMENTS

Figure 1:
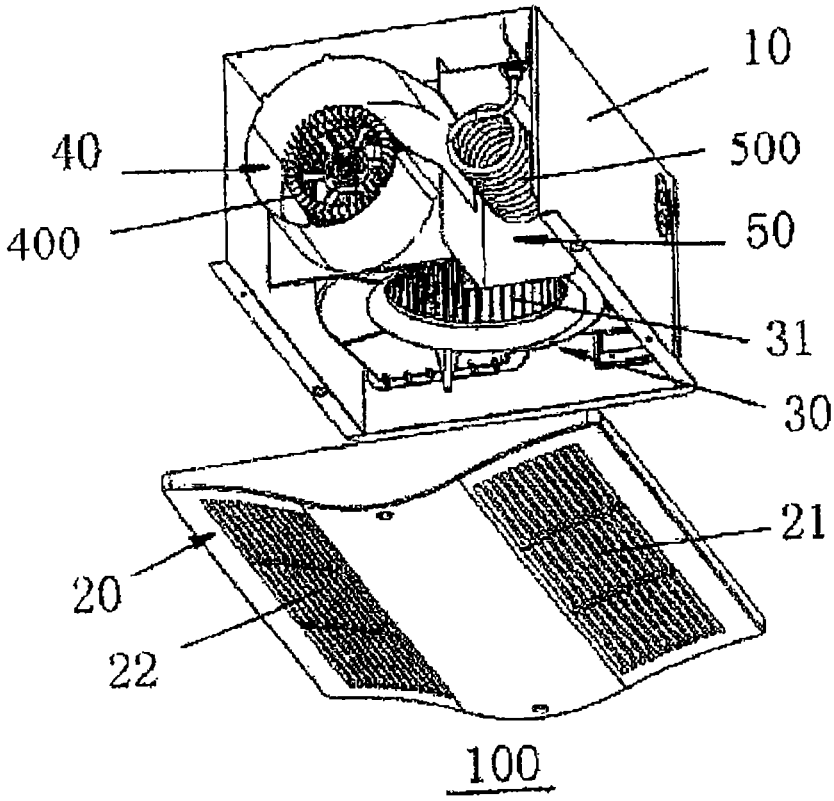
FIG. 1 is a schematic view of a prior art ventilation fan unit.

Preferred embodiments of the present invention will be described hereinafter in detail with reference to the attached drawings, wherein the like reference numerals refer to the like elements throughout the specification. The present invention may, however, be embodied in many different forms and should not be construed as being limited to the embodiments set forth herein; rather, these embodiments are provided so that the present disclosure will be thorough and complete, and will fully convey the concept of the invention to those skilled in the art.

Figure 2A:
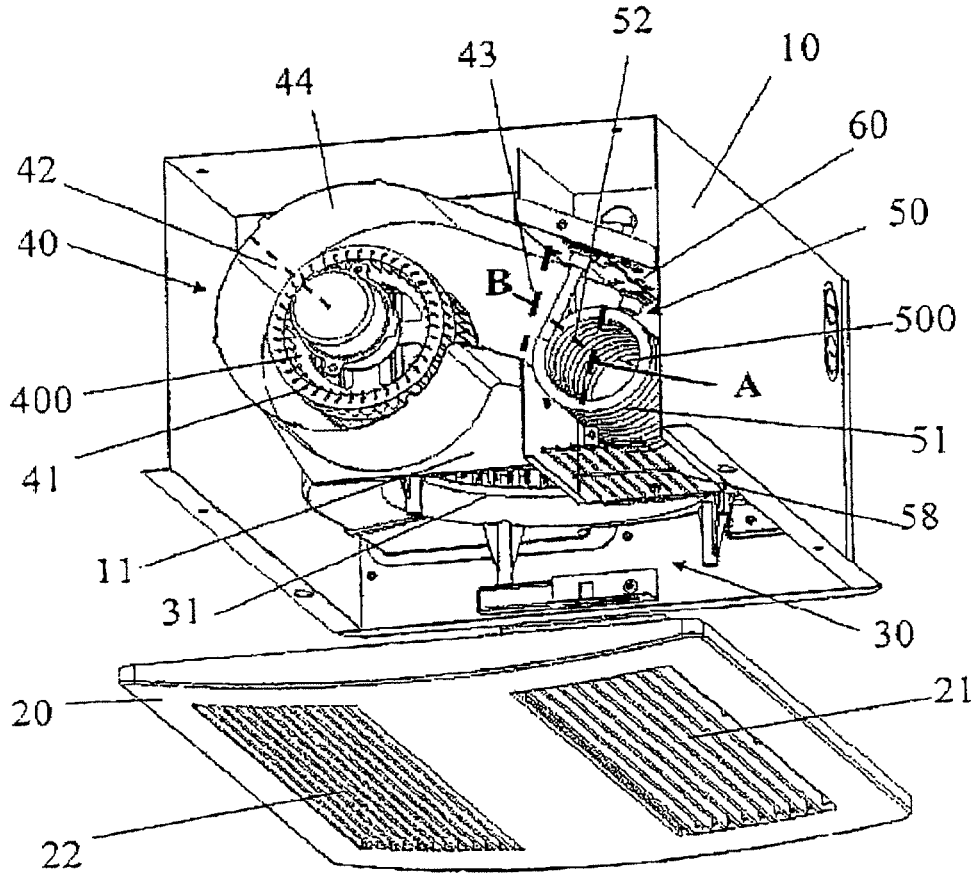
FIGS. 2A, 2B are schematic views of a ventilation fan unit with a heater of the present invention.

FIG. 2A is the schematic view of a ventilation fan unit with a heater of an embodiment of the present invention. The ventilation fan unit includes a frame 10 with non-boxed shape having an opening provided at the underside of a frame 10, and a cover 20 with a part of an air outlet 21 and an air inlet 22 provided at the opening of the frame 10. The frame 10 includes a first portion 30 having a ventilating fan 31, a second portion 40 having a circulating fan 400, and a third portion 50 having a heating portion 500. The circulating fan 400 of the embodiment is a sirocco fan 41, and the heating portion 500 includes a spiral heater 51.

The circulating fan 400 and the heating portion 500 are communicated to each other through an air exit 43. The air is inhaled from the air inlet 22 of the cover 20 to the circulating fan 400, and the air passes through the heating portion 500 to an opening portion 58 of the heating portion 500, while the air is heated during passing through the heating portion 500. As the opening portion 58 is in communication with the air outlet 21 of the cover 20, the heated air is exhaled via above air outlet 21.

Figure 3:
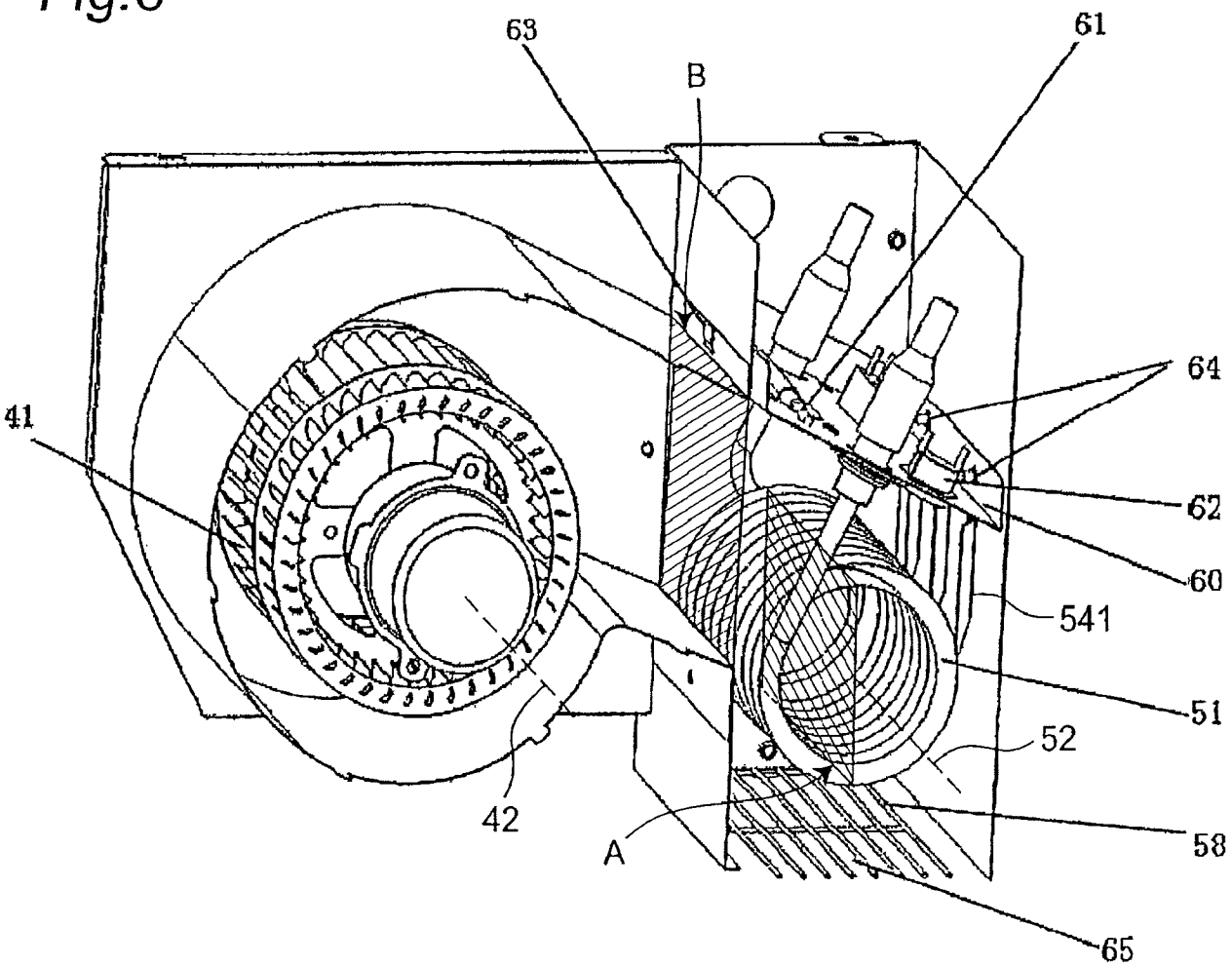
FIG. 3 is a partial schematic view of a rectification plate of the present invention.

As shown in the FIG. 2A and FIG. 3, in the present embodiment, the axis 52 in a spiral shape of the heater 51 is in parallel with the rotation axis 42 of the sirocco fan 41. Further, the sectional area "A" indicated as hatching area in FIG. 3 in the spiral direction of the heater 51 is less than the area "B" indicated as hatching area in FIG. 3 of the air exit 43 of a snail-shaped casing 44 of the circulating fan 400, so that the airflow generated by the sirocco fan 41 passes through the heater 51 so as to be heated. The heater 51 is centrally located adjacent to the air exit 43, so that the center of the air flow blown from the sirocco fan 41 is consistent with the position of the axis 52 in the spiral shape of the heater 51.

The sirocco fan 41 having multi-blades is mounted in the snail-shaped casing 44 to ensure the air volume. Since the airflow through the air exit 43 flows in all directions, it is preferable that the spiral heater 51 be mounted adjacent to the air exit 43. By such position of the heater 51, the surface of the heater 51 is subjected to the airflow in multiple directions, and then the thermal diffusivity of the heater 51 is improved. In another word, the heater 51 uniformly heats the airflow from the air exit 43, thus, the air in the bathroom is also heated uniformly.

Referring to FIG. 2A, the rotation axis 42 of the sirocco fan 41 is located obliquely above the axis 52 of the heater 51, thus, the sirocco fan 41 generates airflow in an oblique downward direction. Furthermore, a rectification plate 60 is connected at the upper portion of the snail-shaped casing 44 and obliquely and downwardly provided at the upper portion of the heating portion 500 for rectifying the airflow from the sirocco fan 41.

The heater 51 is mounted on the rectification plate 60.

Since the air inlet of the sirocco fan 41 is in traverse direction, the whole structure in the cuboid-shaped frame 10 depends on the positioning of the spiral heater 51 and the air exit 43 of the snail-shape casing 44. The air from the sirocco fan 41 is discharged obliquely downwardly, and the rotation axis 42 of the sirocco fan 41 is provided in parallel with the axis 52 of the heater 51, so that the cuboid-shaped frame 10, which houses the whole structure, is more minimized.

Figure 2B:
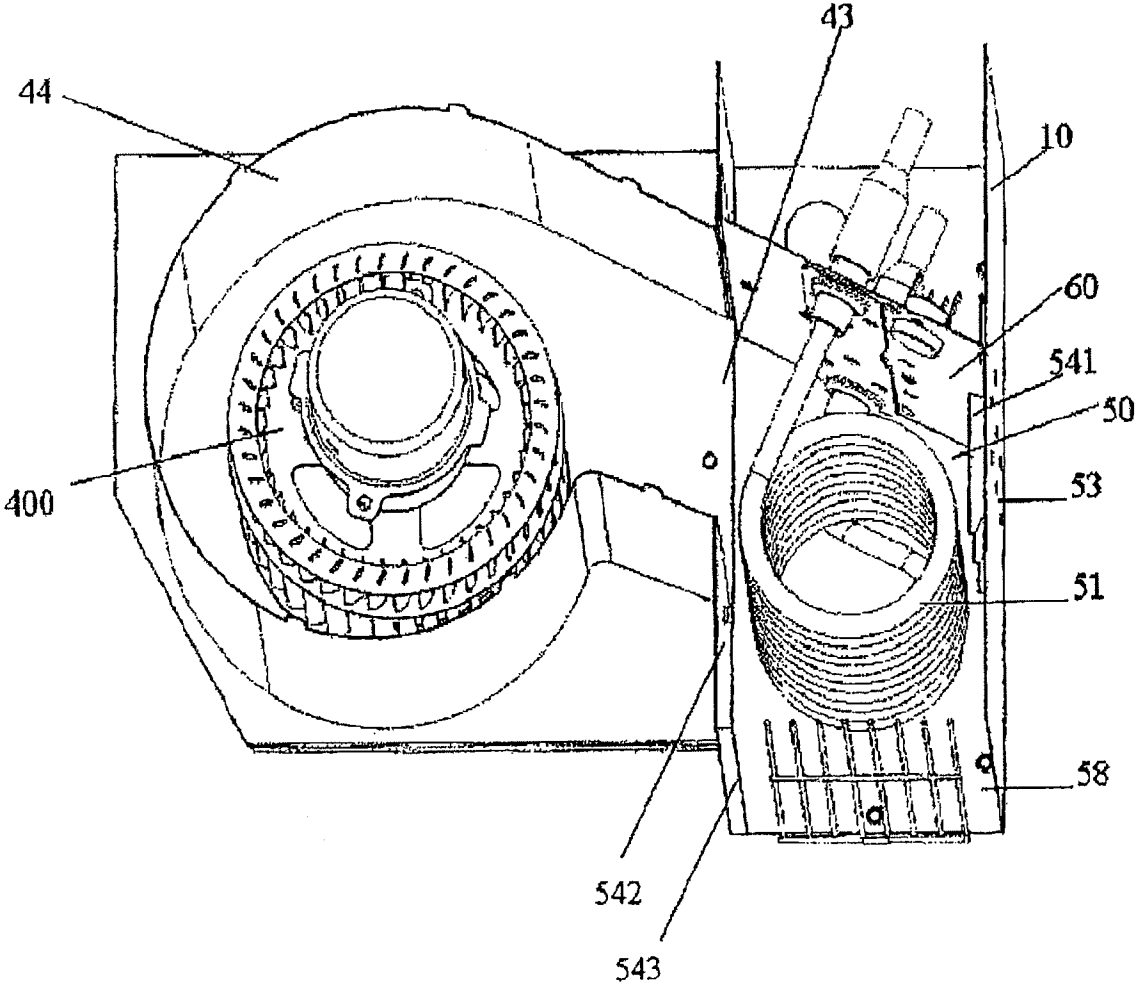

Again, referring to FIG. 2B, a straight strip shaped air guiding plate 541 is provided at an inner side of a plate wall 53 of the heating portion 500 opposite to the air exit 43. And a flex piece 543 is provided at an inner side, which is faced to the opening portion 58, of an edge of a side wall 542 connected with the air exit 43 of the snail-shaped casing 44 of the circulating fan 400. Both the plate wall 53 and the side wall 542 are vertically positioned, and the rectification plate 60 is angled downwardly toward the plate wall 53.

Figure 2C:
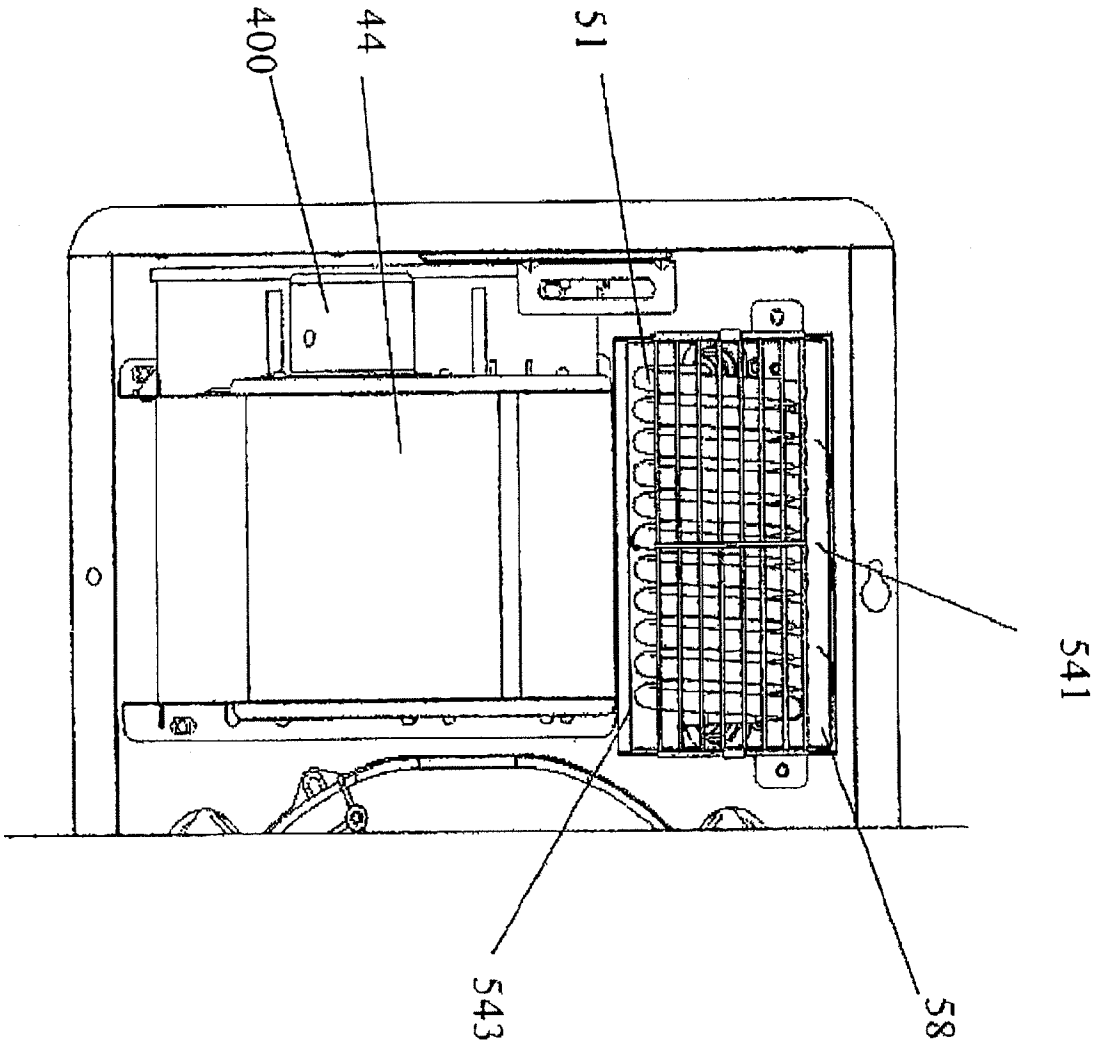
FIG. 2C is a bottom view of a second portion having a circulating fan and a third portion having a heater of the ventilation fan unit with the heater of the present invention.

As shown in FIG. 2C, the air guiding plate 541 is angled by cooperating with a lead angle of the spiral shape of the spiral shaped heater 51. And, along the flow direction of the snail-shaped casing 44, through the air guiding plate 541, the airflow to the rear side of the heater 51 is guided toward the heater 51, and is exhaled via the opening portion 58 after being heated again. At the same time, the airflow diverging between the heater 51 and the side wall 542 is combined with the heated airflow under the guiding effect of the flex piece 543.

The FIG. 3 is a partial schematic view of a rectification plate 60. A temperature fuse 61 is installed on the rectification plate 60; of course, other types of the temperature overheating protection device also can be installed. When the sirocco fan 41 works abnormal and is unable to generate airflow, the temperature fuse 61 can detect abnormal temperatures and send out an alarm signal or turn off the power of the heater 51 under the heat radiation and the convention of the heater 51, which is mounted lower than the temperature fuse 61.

Furthermore, a temperature sensor 62 is mounted at the lower portion of the rectification plate 60 where the air temperature can be detected. An air temperature adjustment device (not shown) and an air volume adjustment device (not shown) are provided for controlling the sirocco fan 41. In use, firstly, the user may set a predetermined arbitrary warm air temperature through the air temperature adjustment device (not shown). Then, the temperature of the air heated through the heater is sensed by the temperature sensor 62, and the sensed information is transferred to the air temperature adjustment device (not shown). The predetermined temperature set by the user and the sensed temperature are compared, and then, the rotation speed of the sirocco fan 41 is controlled by the air volume adjustment device (not shown), and the air volume of the sirocco fan 41 is adjusted so as to obtain the warm airflow with the temperature set by the user.

The upper portion of the rectification plate 60 is fixed through a hook 63 and the lower portion thereof is fixed by a screw 64. Such design will greatly facilitate installation of the rectification plate 60.

The heater 51, the temperature fuse 61, and the temperature sensor 62 are provided together on the rectification plate 60, so that they are easy to connect to the power wires related to heating. Therefore, the assembling workability of electrical wiring is improved.

Furthermore, for security concern, a protection cover 65 is provided at the opening portion 58 at the lower side of the heater 51 so as to prevent the finger from being stretched in.

Figure 4A:
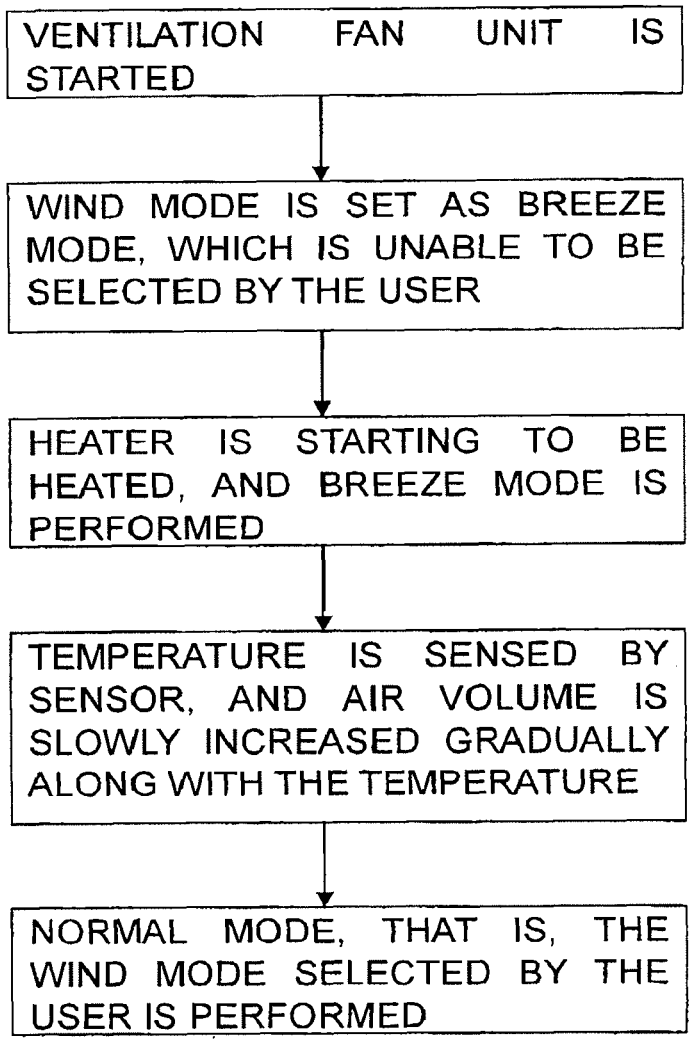
FIG. 4A is a control flow chart of the ventilation fan unit with the heater of the present invention, when the ventilation fan unit is powered off.
Figure 4B:
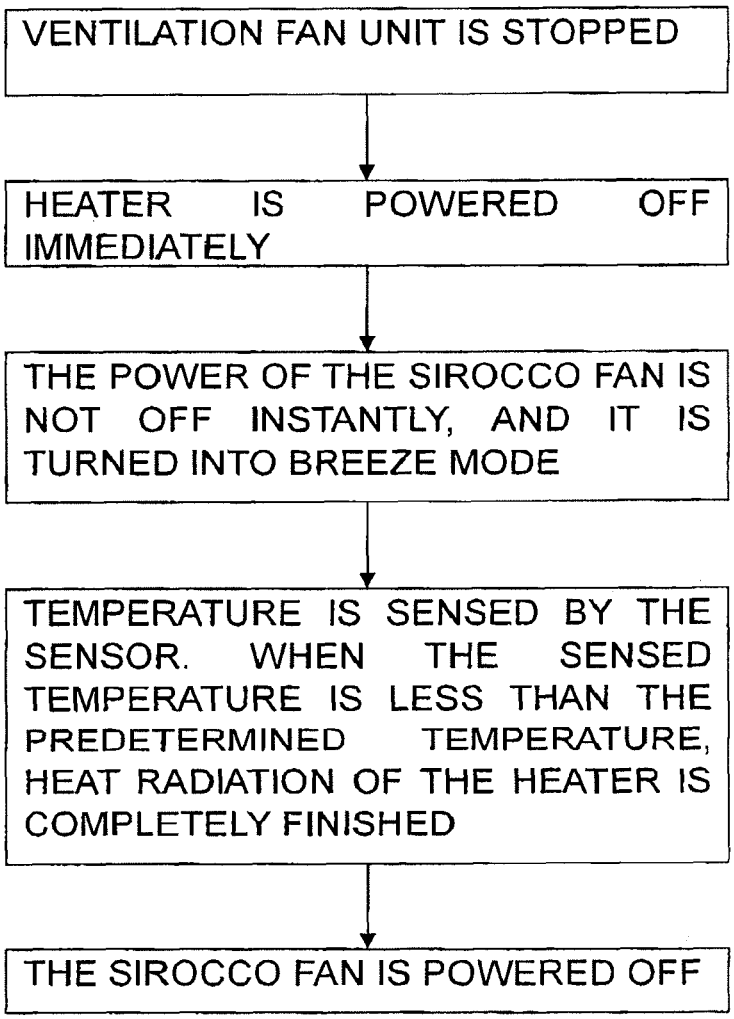
Figure 5:
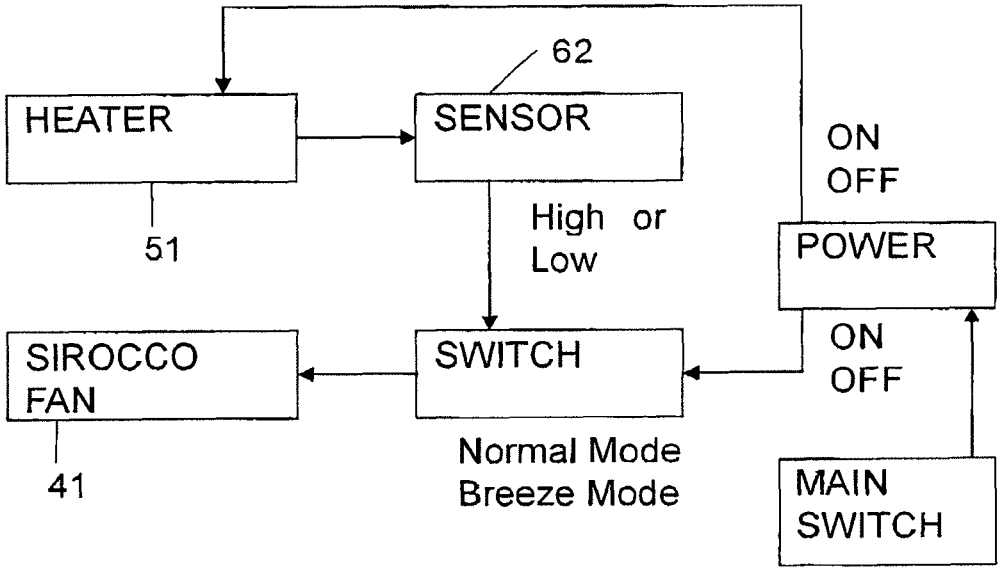
FIG. 5 is a block diagram of the ventilation fan unit of the present invention.

FIGS. 4A and 4B are control flow charts of the sirocco fan 41. FIG. 5 is a block diagram of the ventilation fan unit. In the present invention, since both the heat generation and the heat radiation of the heater 51 need a progressive process, if a lot of airflow is generated before the heater 51 is normally heated, then the airflow is a kind of cold wind and the user may feel uncomfortable. If the sirocco fan 41 is powered off immediately when the user stops using the ventilation fan unit, at such time, the heater 51 is still under the high temperature state, and it only can be cooled down by self radiation heat. Therefore, in addition to the normal mode, the sirocco fan 41 of the present invention is also provided with a breeze mode, and such breeze mode is performed automatically and is unable to be selected by the user. When the breeze mode is performed, the user is hard to feel the wind from the air outlet 21.

As shown in FIG. 4A and FIG. 5, while the heater 51 is not completely heated after powered on, firstly, the breeze mode is automatically initiated, and at the same time, the air volume is slowly increased gradually along with the temperature, and then, finally, the normal mode, that is, the wind mode selected by the user is performed. Thus, in the whole process, the above control process prevents mass volume of the cold airflow from being generated at the starting to operation of the ventilation fan unit.

As shown in FIG. 4B and FIG. 5, after the ventilation fan unit is stopped, the heater 51 is powered off immediately, however, the power of the sirocco fan 41 is not off instantly, and it is turned into the breeze mode, and the temperature thereof is sensed by the temperature sensor 62. It is stopped when the sensed temperature is less than the predetermined temperature and after the heat radiation of the heater 51 is completely finished. By such design, it can be ensured that the heat in the third portion 50 is fully discharged.

It would be appreciated by those skilled in the art that many modifications, alterations and substitutions may be made in these embodiments without departing from the principles and spirit of the invention, the scope of which is defined in the claims and their equivalents.

What the claim is:

1. A ventilation fan unit with a heater, comprising:

a frame with an opening provided at an underside of the frame;

a cover having an air outlet and an air inlet provided at the opening of the frame;

a snail-shaped casing with an air exit provided in the frame;

a circulating fan enclosed in the snail-shaped casing;

a heating portion including a spiral heater mounted at the air exit of the snail-shaped casing, wherein the heating portion communicates with the circulating fan through the air exit; and a rectification plate extending inwardly from the frame, one end of the rectification plate being connected to the frame and an other end of the rectification plate being connected at an upper portion of the air exit of the snail-shaped casing, the rectification plate being located above the heater, and being configured to direct air from the circulating fan towards the heater, wherein an axis of the spiral heater is parallel with a rotation axis of the circulating fan, wherein the rotation axis of the circulating fan is located above and horizontally spaced from the axis of the spiral heater, wherein the rectification plate is positioned so as not to block airflow from the snail-shaped casing to the heater, wherein the heater is directly attached to the rectification plate, and wherein a sectional area, in a spiral direction of the heater is less than an area of the air exit of the snail-shaped casing.

2. The ventilation fan unit with the heater as claimed in claim 1, further comprising an air guiding plate having a straight strip shape, which is provided on a first wall plate opposite to the air exit of the casing, and the heater is interposed between the air exit of the snail-shaped casing and the air guiding plate, wherein the air guiding plate forms an angle with the first wall plate.

3. The ventilation fan unit with the heater as claimed in claim 2, wherein the air guiding plate is configured to guide the air which is guided from the rectification plate to the heater.

4. The ventilation fan unit with the heater as claimed in claim 1, further comprising a temperature overheating protector mounted at an upper side of the rectification plate, above the heater.

5. The ventilation fan unit with the heater as claimed in claim 4, wherein the temperature overheating protector is a temperature fuse.

6. The ventilation fan unit with the heater as claimed in claim 1, further comprising a temperature sensor that is attached to the rectification plate and mounted at a downstream side of the rectification plate where the heated air is sensed.

7. The ventilation fan unit with the heater as claimed in claim 1, further comprising a protective cover for covering the heating portion, which is provided at an opening of the heating portion, so as to prevent a user's finger from being inserted into the heating portion.

8. The ventilation fan unit with the heater as claimed in claim 1, wherein the circulating fan is provided with a normal mode and a breeze mode, when the heater is not completely heated after being powered on, the breeze mode is performed, and then, when the heater is completely heated, the normal mode is performed.

9. The ventilation fan unit with the heater as claimed in claim 8, wherein after the heater is powered off, the circulating fan is powered off to stop operation after the heater performs the breeze mode until a predetermined temperature of the air is reached.

10. The ventilation fan unit with the heater as claimed in claim 1, further comprising a device for controlling the circulating fan by adjusting the air volume, to stabilize a temperature of the airflow by adjusting the volume of the air.

11. The ventilation fan unit with the heater as claimed in claim 1, further comprising:

a ventilating fan provided in the frame; and a second wall plate connected with the air exit of the snail-shaped casing of the circulating fan, wherein one end of the second wall plate located at an opening of the heating portion is bent inwardly.

12. The ventilation fan unit with the heater as claimed in claim 1, wherein the rectification plate extends from an end of the upper portion of the air exit of the snail-shaped casing, toward an outside of the snail-shaped casing.

13. The ventilation fan unit with the heater as claimed in claim 12, wherein the upper portion of the air exit of the snail-shaped casing is located above the circulating fan that directs air to the heater.

14. The ventilation fan unit with the heater as claimed in claim 1, wherein at least a portion of each of two major surfaces of the rectification plate does not contact the frame.

15. The ventilation fan unit with the heater as claimed in claim 1, wherein the rectification plate extends from the frame in a direction of the snail-shaped casing to which the rectification plate is connected.

16. The ventilation fan unit as claimed in claim 1, wherein the rectification plate is a flat plate, and a first wall plate, to which one end of the rectification plate is attached, is positioned opposite to the exit of the casing.

17. A ventilation fan unit with a heater comprising:

a frame with an opening provided at an underside of the frame;

a cover having an air outlet and an air inlet provided at the opening of the frame;

a snail-shaped casing with an air exit provided in the frame;

a circulating fan enclosed in the snail-shaped casing;

a heating portion including a spiral heater mounted at the air exit of the snail-shaped casing, wherein the heating portion communicates with the circulating fan through the air exit; and a rectification plate extending inwardly from the frame, one end of the rectification plate being connected to the frame and an other end of the rectification plate being connected at an upper portion of the air exit of the snail-shaped casing, the rectification plate being located above the heater, and being configured to direct air from the circulating fan towards the heater, wherein the rectification plate is positioned so as not to block airflow from the snail-shaped casing to the heater, wherein the ventilation fan unit further comprises a device for controlling the circulating fan by adjusting the air volume, to stabilize a temperature of the airflow by adjusting the volume of the air, wherein an air temperature adjuster is provided for controlling the circulating fan to adjust the temperature of the airflow, and wherein an axis of the spiral heater is parallel with a rotation axis of the circulating fan, wherein the rotation axis of the circulating fan is located above and horizontally spaced from the axis of the spiral heater.

18. A ventilation fan unit with a heater comprising:

a frame with an opening provided at an underside of the frame;

a cover having an air outlet and an air inlet provided at the opening of the frame;

a snail-shaped casing with an air exit provided in the frame;

a circulating fan enclosed in the snail-shaped casing;

a heating portion including a spiral heater mounted at the air exit of the snail-shaped casing, wherein the heating portion communicates with the circulating fan through the air exit; and a rectification plate extending inwardly from the frame, one end of the rectification plate being connected to the frame and an other end of the rectification plate being connected at an upper portion of the air exit of the snail-shaped casing, the rectification plate being located above the heater, and being configured to direct air from the circulating fan towards the heater, wherein the rectification plate is positioned so as not to block airflow from the snail-shaped casing to the heater, wherein the ventilation fan unit further comprises an air guiding plate having a straight strip shape, which is provided on a first wall plate opposite to the air exit of the snail-shaped casing, and the heater is interposed between the air exit of the snail-shaped casing and the air guiding plate, wherein the air guiding plate forms an angle with the first wall plate, wherein the air guiding plate is configured to guide the air which is guided from the rectification plate to the heater, wherein the air guiding plate is positioned downstream of the rectification plate in the airflow from the snail-shaped casing to the heater, wherein an axis of the spiral heater is parallel with a rotation axis of the circulating fan, and wherein the rotation axis of the circulating fan is located above and horizontally spaced from the axis of the spiral heater.

* * * * *